United States Patent [19]

Jensen

[11] 4,135,335

[45] Jan. 23, 1979

[54] BLOCKING-UP WEDGE

[76] Inventor: Karsten Jensen, Strandvejen 93, Frederiksvaerk, Denmark, DK-3300

[21] Appl. No.: 775,498

[22] Filed: Mar. 8, 1977

[30] Foreign Application Priority Data

Mar. 19, 1976 [DK] Denmark ..... 1200/76

[51] Int. Cl.[2] ..... E04D 15/00

[52] U.S. Cl. ..... 52/126; 248/188.2; 254/104

[58] Field of Search ..... 52/126, 217, 584; 252/104; 104/88; 248/188.2, 23; 85/67

[56] References Cited

U.S. PATENT DOCUMENTS

| | | | |
|---|---|---|---|
| 2,709,571 | 5/1955 | Mafera | 254/104 |
| 2,772,596 | 12/1956 | Trussell | 254/104 X |
| 2,819,037 | 1/1958 | Wilkin | 248/188.2 X |
| 3,030,730 | 4/1962 | Costar | 254/104 X |
| 3,836,118 | 9/1974 | Meyer | 254/104 |

*Primary Examiner*—Price C. Faw, Jr.
*Assistant Examiner*—Carl D. Friedman
*Attorney, Agent, or Firm*—Karl W. Flocks

[57] ABSTRACT

A blocking-up wedge of the kind used in pairs for the levelling of joists and the like consisting of a prismatic-shaped body, the terminal surfaces of which being triangles, and at least one wedge surface being provided with a relatively great friction profiled formation in such a direction that the mutual displacement of the pair of wedges reducing the distance between the parallel supporting surfaces of the pair of wedges is principally prevented and lateral shifting of the wedges is controlled or prevented.

4 Claims, 3 Drawing Figures

BLOCKING-UP WEDGE

The present invention relates to a blocking-up wedge of the kind used in pairs e.g. by the levelling of joists and consisting of a prismatic-shaped body the terminal surfaces of which being triangles, by which at least one wedge surface offers a relatively great friction in such a direction that the mutual displacement of the pair of wedges reducing the distance between the parallel supporting surfaces of the pair of wedges is mainly prevented, as well as of controls for the prevention of mutual lateral shifts of the wedges.

A pair of wedges as described could be imagined cut out along a diagonal plane of a box, and in the application the two cuts will be adjoining each other. It is hereby achieved that the surface supported by the pair of wedges and e.g. is resting on a concrete rough floor, and the surface supporting the pair of wedges and e.g. is carrying a joist are mutually parallel, irrespective of the mutual distance, which may be varied by shifting of the wedges between them along the line of the cut.

When blocking-up wedges of the said construction are made of wood the interacting inclined planes will usually offer so much friction that it is unnecessary to take special friction-promoting precautions.

In case of blocking-up wedges of plastic precautions must generally be taken to prevent with reasonable certainty that the two wedges of the pair will not slide mutually so that the distance between the supporting faces of the pair of wedges is reduced and the above lying floor will sink. It is usual therefore that the inclination of the wedge is made with a serrated profile, which will not hamper the displacement of the wedges in one direction but increase the friction substantially in the direction in which the distance between the supporting faces is reduced.

When the joists are inserted and blocked up on such wedges, the artisan may often stabilize the construction by hammering a nail through the joist and the two wedges. This will, however, prevent subsequent minor adjustments or require that the nail is removed before such adjustments.

Accordingly fixing by nails is unfortunate and furthermore impossible when the material of which the wedges are made is not nailable.

The aim of the nailing is to prevent that the two wedges will slide mutually at right angles to the desired direction of displacement. Such a displacement, which may involve that the two wedges will entirely miss their mutual engagement with resultant function, is occasionally occurring with an exerted load on the joist at some distance from the pair of wedges. This may cause the joist to bend down and exert a displacing force in the longitudinal direction on the upper wedge.

From the specifications of Danish Pat. No. 121.577 it is known that the said controlling device may consist of at least one longitudinal track ending at one end in a boss.

When two wedges of the said description are joined together with the mentioned boss in the track of the other wedge, the wedges can no longer be displaced mutually in the transverse direction.

This may in certain situations appear a disadvantage, if the user needs a displacement of one of the wedges in the transversal direction or intends to place it in an inclining position relative to the other wedge. Such a need may for example arise, if the space between the foundation and the object supported by the pair of wedges is not free.

Another disadvantage of the wedges known from the Danish patent description is that the protruding boss on a wedge surface prevents that the said face from turning away from the other wedge. Even this may contribute to limit the field of application of the known type of wedges.

The object of the present invention is to devise a blocking-up wedge of the described nature, however, without the mentioned disadvantages of previously known wedges.

This is according to the invention achieved in that the said controlling organs are provided by a profiling of the described character of at least a section of the inclining wedge surface causing a hampering or in practice a prevention of mutual displacement of the two interacting wedges in the direction parallel with the opposing edge of the face.

By this embodiment is achieved that the wedges of an interacting pair of wedges can be displaced mutually in the transversal direction, or that one of the blocks can be turned relative to the other on the opposing face, and further that one or both wedges can be reversed. The latter fact will bring about that each wedgemay have two inclining wedge surfaces. If the terminal surfaces of the wedge constitute an isosceles triangle, the user may turn the wedges arbitrarily.

BRIEF DESCRIPTION OF THE DRAWING

In FIG. 1 it may be seen that each of the wedges constitutes a prismatic-shaped body 1, the terminal surfaces of which are triangular. At least one of the lateral faces constitutes an inclining wedge surface, by which the wedge interacts with a corresponding wedge. This inclining face can in the usual manner be provided with a profile 2, which is not preventing the unhampered shifting mutually of the two wedges in the direction A that increases the distance between the two supporting faces of the pair of wedges 3 and 4, but will prevent, when the pair of wedges is under load, a mutual displacement in the opposite direction B, reducing the said distance.

The profiling 2 of the inclining surface can e.g. be serrated incisions or portions extending in the face from an upper end to a lower end of the wedge and be situated so that the profiling of the two interacting wedge surfaces engage mutually.

The inclining face is according to the invention also provided with a profiling 5 such that the wedges under load cannot or only by overcoming of a substantial friction be displaced mutually in the direction parallel with the edge opposing the face, as indicated by the double arrow C.

Figure 1:
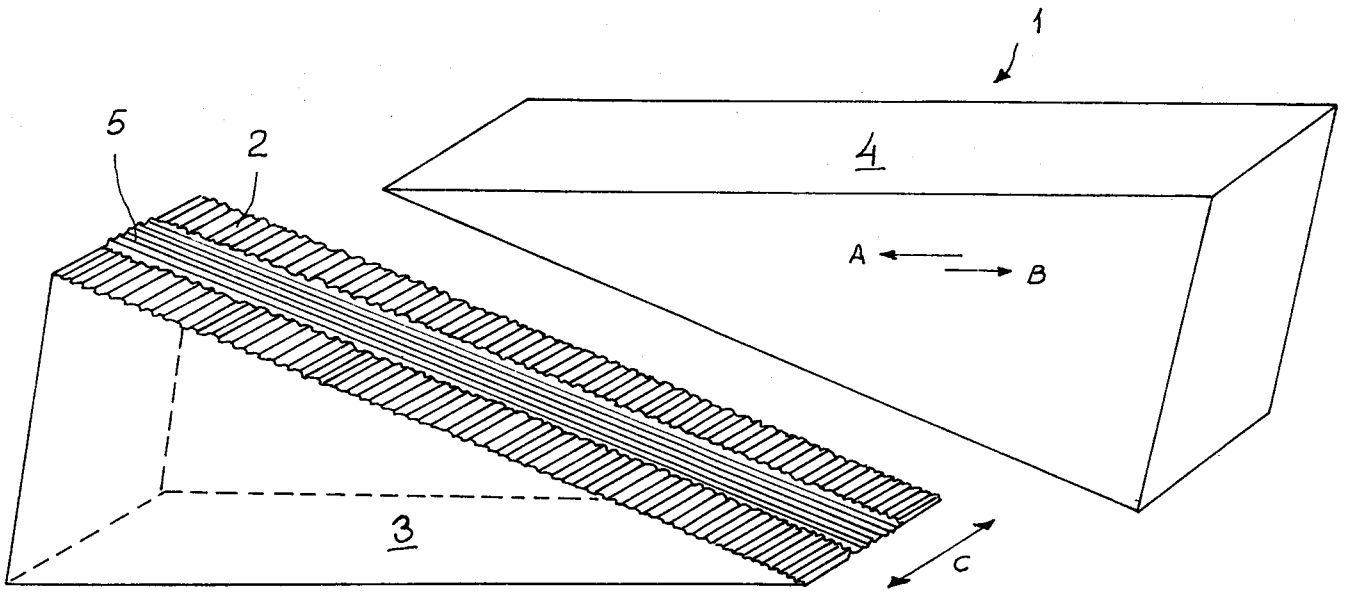
FIG. 1 is a view in perspective showing two wedges according to the invention removed from the mutually interacting position.
Figure 2:
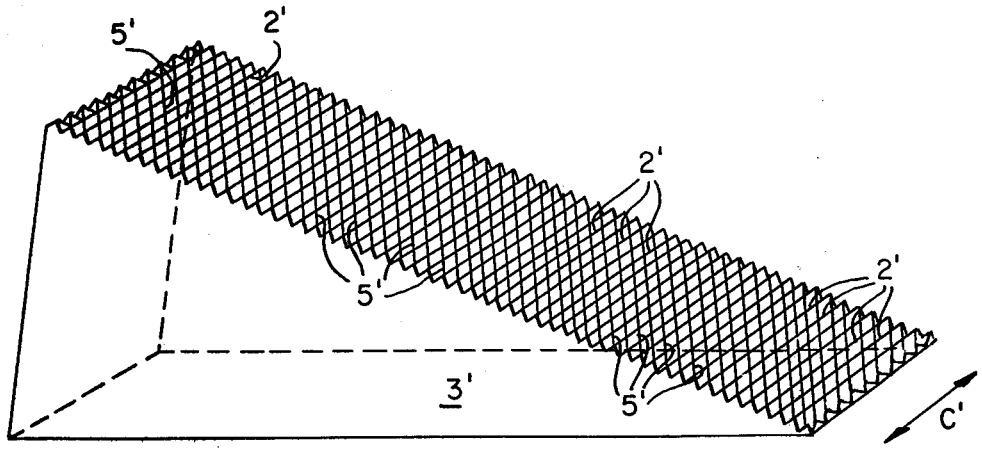
FIG. 2 is a view in perspective showing an alternative embodiment of the wedge structure illustrated in FIG. 1.
Figure 3:
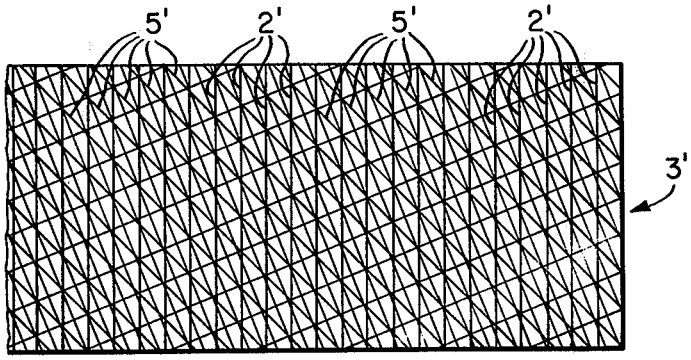
FIG. 3 is a plan view of a fragment of the working face of the wedge member illustrated in FIG. 2, but drawn on an enlarged scale.

The profiling 5 can e.g. constitute a series of undulating portions of V-shaped incisions extending in the surface in a direction transversely of the direction in which the serrated portions 2 extend and be situated between two spaced apart bands 2 along the sides of the face of the first-mentioned profiling 2. Alternatively, the working face of a wedge 3', as illustrated in FIGS. 2 and 3, may according to the present invention include V-profiling 5' and serrated profiling 2'' can be changed or combined to form a uniform profile covering the entire face in the form of two sets of intersecting serrated incisions extending with at least one of the sets of incisions obliguely relative to the edges of the body.

It will be obvious to those skilled in the art that various changes may be made without departing from the scope of the invention and the invention is not to be considered limited to what is shown in the drawings and described in the specification.

What is claimed is:

1. Blocking-up wedges of the kind used in pairs e.g. by the leveling of joists wherein both of said wedges are identical to each other, and each of said wedges consists of a prismatic-shaped body the terminal surfaces of which being triangles, by which at least one wedge surface of each of said wedges offers a relatively great friction in such a direction that the mutual displacement of the pair of wedges reducing the distance between the parallel supporting surfaces of the pair of wedges is mainly prevented, as well as of controls for the prevention of mutual lateral shifts of the wedges, wherein said at least one wedge surface comprises serrated portions extending from an upper end to a lower end of said wedge and a plurality of undulating portions extending in a direction transversely of the direction in which said serrated portions extend.

2. The wedger as defined in claim 1 wherein said serrated portions are in the form of two spaced-apart bands with said undulating portions situated between said two spaced-apart bands.

3. The wedger as defined in claim 1 wherein said undulating portions and said serrated portions are so as to intersect and extend through each other.

4. The wedger as defined in claim 3 wherein at least said undulating portions extend obliquely relative to edges of said wedge.

* * * * *